US006186098B1

(12) United States Patent
Choi

(10) Patent No.: US 6,186,098 B1
(45) Date of Patent: Feb. 13, 2001

(54) COAXIAL OSCILLATING AXISYMMETRIC ENGINE

(76) Inventor: Jin-Hee Choi, Youk Sa APT. 516, Gongneung-dong, Nowon-ku, Seoul 139-240 (KR)

( * ) Notice: Under 35 U.S.C. 154(b), the term of this patent shall be extended for 0 days.

(21) Appl. No.: 09/331,060

(22) PCT Filed: Nov. 9, 1998

(86) PCT No.: PCT/KR98/00358

§ 371 Date: Jun. 16, 1999

§ 102(e) Date: Jun. 16, 1999

(30) Foreign Application Priority Data

| | | |
|---|---|---|
| Jan. 21, 1998 | (KR) | 98-1627 |
| Apr. 30, 1998 | (KR) | 98-15677 |
| Apr. 30, 1998 | (KR) | 98-15678 |
| Sep. 21, 1998 | (KR) | 98-39022 |

(51) Int. Cl.[7] ..... F02B 53/00
(52) U.S. Cl. ..... 123/18 R; 74/50
(58) Field of Search ..... 123/18 R, 18 A; 74/50; 91/339

(56) References Cited

U.S. PATENT DOCUMENTS

| | | | | |
|---|---|---|---|---|
| 1,069,936 | | 8/1913 | Frank . | |
| 1,529,352 | * | 3/1925 | Hagberg et al. | 123/18 R |
| 1,737,082 | * | 11/1929 | Gough | 123/18 R |
| 1,744,542 | * | 1/1930 | Gough | 123/18 R |

FOREIGN PATENT DOCUMENTS

| | | |
|---|---|---|
| 2 110 672 | 9/1972 | (DE) . |
| 2 297 323 | 6/1976 | (FR) . |
| 336 465 | 6/1930 | (GB) . |

* cited by examiner

*Primary Examiner*—Michael Koczo
(74) *Attorney, Agent, or Firm*—Nath & Associates; Harold L. Novick

(57) ABSTRACT

A coaxial oscillating axisymmetric engine is disclosed. The engine is provided with a rotor having a plurality of rotating blades, the blades being movable relative to a plurality of fixed blades of a stator in opposite directions while forming expansion and compression chambers in each cylinder of a housing assembly. The rotor thus generates rotational force transmitted to an output shaft through a power transmission unit. The transmission unit has two guide rails, inwardly mounted to the rotor at diametrically opposed positions and individually having a guide channel. A slider movably engages with each of the guide rails so as to be linearly movable along the guide channel. A ball housing is coaxial and axisymmetrically coupled to the slider and is rotatively coupled to each of the drive shaft.

12 Claims, 15 Drawing Sheets

COAXIAL OSCILLATING AXISYMMETRIC ENGINE

TECHNICAL FIELD

The present invention relates, in general, to coaxial oscillating axisymmetric engines and, more particularly, to a coaxial oscillating axisymmetric engine with a plurality of rotating blades of a rotor being movable relative to a plurality of fixed blades of a cylindrical housing in opposite directions while forming expansion and compression chambers in each cylinder of a housing assembly, thus generating rotational force.

DESCRIPTION OF THE PRIOR ART

The conventional reciprocating engines have been utilized due to their efficient and simple conversion of reciprocating motion of the pistons, to a rotary motion via a crankshaft. However, the conventional reciprocating internal combustion engines have fuel efficiency limitations imposed by friction due to the multiplicity of moving parts. These moving parts generally include the bearing journals where friction increases with the speed of rotation and the number of bearings, and the piston rings that impose friction by the plurality components operating as a combined system that contributes significant friction to the engine as a whole.

In addition, thermal efficiencies of reciprocating internal combustion engines are decreased by the redundancy of the mechanical components, the materials used, the manner of operation and, the use of a common cylinder portion for all the cycle phase. Fuel efficient conventional reciprocating internal combustion engines do exist but are highly complex units. Such complexity makes manufacturing and assembly cost high.

The Wankel rotary engine has found application in motor vehicles because of its potential of high performance. For various reasons, however, it has not been utilized for general use as a replacement for the conventional piston engines such as commuter vehicles or mass produced small industrial engines.

Some other types of rotary engines have also been proposed. These include toroidal engines having a toroidal cylinder built in the cylinder housing around a driving shaft assembly, rotor supported for rotation about the drive shaft and coupled to pistons in the toroidal shaped cylinder whereby the pistons move cyclically toward and away from one another forming expanding and contracting working chambers within the toroidal cylinder, and, inlet and outlet ports extending through the cylinder housing assembly for entry and exit of fluid to and from the working chambers.

Typical prior arts of toroidal engines are outlined in "THE WANKEL ENGINE DESIGN DEVELOPMENT APPLICATIONS" by Jan P Norbye published by the Chilton Book Company. French patent No. 2498248 and German patent No. 3521593 illustrate prior art toroidal engines. Some of these engines utilize external mechanism to effect the cyclic motion of the pistons, which move within the cylinder, while others utilize swash plates and cams and the like in the power train to achieve the desired mechanical coupling of the drive components.

For the purpose of the production, it is considered that all these prior art engines have disadvantages either in efficiency, configuration, or satisfactory performance under normal working loads such as sustained optimum power delivery. Conclusively many of the prior art engines have many shortcomings such as sophisticated manufacturing and inefficient performance.

DISCLOSURE OF THE INVENTION

Accordingly, the present invention has been made in consideration of the problems mentioned above in the prior art. The first object of this invention is to provide a coaxial oscillating axisymmetric engine-which will be mentioned as CoReA engine hereinafter-which is provided with a rotor having the plurality of rotating blades, the rotating blades being movable relative to the plurality of fixed blades of a cylindrical housing in opposite directions while forming expansion and compression chambers in each cylinder of a housing assembly, thus generating rotational force which is transmitted to an output shaft through a power transmission unit.

The second object of this invention is to provide a coaxial oscillating axisymmetric engine being provided with valve driving mechanisms for periodically opening intake and exhaust ports of the housing assembly to supply air to each cylinder of the engine and to discharge the exhaust gas therefrom.

The third object of this invention is to provide a coaxial oscillating axisymmetric engine with cooling means to avoid thermal overload, combustion of the lubricating oil on the rotor sliding surface and uncontrolled combustion due to excessive temperature of a plurality of fixed blades surrounding a hot combustion chamber.

The fourth object of this invention is to provide a coaxial oscillating axisymmetric engine being provided with a lubrication unit to lubricate and cool all of the friction contacting parts.

In order to accomplish the first object, this invention provides a coaxial oscillating axisymmetric engine, comprising a housing assembly comprising; a first stator consisting of first and second annular discs, the second disc being provided with a plurality of regularly spaced fixed blades at one side thereof, a second stator arranged in parallel to and spaced apart from the first stator, thus forming a stator assembly in cooperation with the first stator, the second stator consisting of third and fourth annular discs, a cylindrical housing fitted over the first and second stators, thus closing the periphery of the stator assembly, a plate arranged the outside of the first stator; and a cover arranged the outside of the second stator and integrated with the plate using a plurality of locking bosses; a cylindrical rotor having a plurality of regularly spaced rotating blades at its periphery and rotatively arranged the inside of the housing assembly with the rotating blades being positioned between the fixed blades of the first stator, the rotating blades individually forming one variable expansion chamber and one variable compression chamber between the fixed blades; a gear box arranged the inside of the rotor; a toothed output shaft rotatively set in the gear box and extending to the outside of the housing assembly; and a power transmission unit used for coaxial and axisymmetrically transmitting a rotating force of the rotor to the output shaft through two toothed drive shafts, the drive shafts commonly engaging with the output shaft at their toothed parts the inside of the gear box.

The power transmission unit comprises: two guide rails inwardly mounted to the rotor at diametrically opposite positions and individually having a guide channel; a slider having a guide ball and a guide slot at both ends and movably engaging with each of the guide rails, and so to be linearly movable along the guide channel; and a ball housing coaxial and axisymmetrically coupled to the slider, the ball housing consisting of: a ball seat rotatively receiving the ball of the slider; and a connection part extending from the ball seat and rotatively coupled to each of the drive shafts.

In order to accomplish the second object, this invention provides a coaxial oscillating axisymmetric engine, comprising: a cylinder housing being provided with a plurality of regularly spaced fixed blades; a cylindrical rotor having a plurality of regularly spaced rotating blades at its periphery and rotatively arranged inside the cylindrical housing, said rotating blades individually forming one variable expansion chamber and one variable compression chamber between the fixed blades of the housing; a gear box arranged the inside the rotor; a toothed output shaft rotatively set in said gear box and extending to the outside of said housing assembly; an idle shaft is provided with an idle gear meshing with the opposite bevel gears of the two toothed driving shafts and arranging opposite side of the output gear of the output shaft; a power transmission unit used for coaxial and axisymmetrically transmitting a rotating force of the rotor to said output shaft through the driving shafts; inner covers surrounding both sides of said rotor to form a plurality of combustion chambers of the cylindrical housing; rotating disc valves being arranged on the outside of each of the second and third fixed disc and having at least two valve holes which periodically communicate with the combustion chambers of the cylindrical housing; valve supporting means being rotatively supported by the rotating disc valves; and a valve driving mechanisms to rotate the rotating disc valves.

The valve driving mechanism comprises two planetary gear sets consisting of: a sun gear being rotated with the output shaft or the idle shaft; a pinion gear assembly having a pinion shaft being rotatively supported by the third fixed disc, a plurality of first pinions fixed to an end of the pinion shaft for meshing with the sun gear, and a plurality of second pinions fixed to the other end of the pinion shaft; and a ring gear assembly provided with a internal ring gear for meshing with the second pinions and connected with the rotating disc valve.

In order to accomplish the third object, this invention provides a coaxial oscillating axisymmetric engine, wherein the rotating blade of the rotor is provided with a first cooling unit consisting of a coolant jacket which is in communication with a coolant passage of the output shaft through a plurality of coolant inlet holes of the rotor.

In order to accomplish the fourth object, this invention provides a coaxial oscillating axisymmetric engine, wherein the rotating blade of the rotor is provided with a first lubrication unit comprising: an oil jacket formed the inside of the rotating blade flowing oil from an oil passage of the output shaft; an oil groove formed along the outside edge of the rotating blade communicating with the oil jacket through an oil chamber; a lubrication roll movably received in the oil groove; and at least one plungers retained in the oil chamber in order to bias the lubrication roll to the outer surface of the rotor by at least one spring.

BRIEF DESCRIPTION OF THE DRAWINGS

The above and other objects, features and other advantages of this invention will be more clearly understood from the following detailed description taken in conjunction with the accompanying drawings, in which.

DETAILED DESCRIPTION OF THE INVENTION

Figure 1:
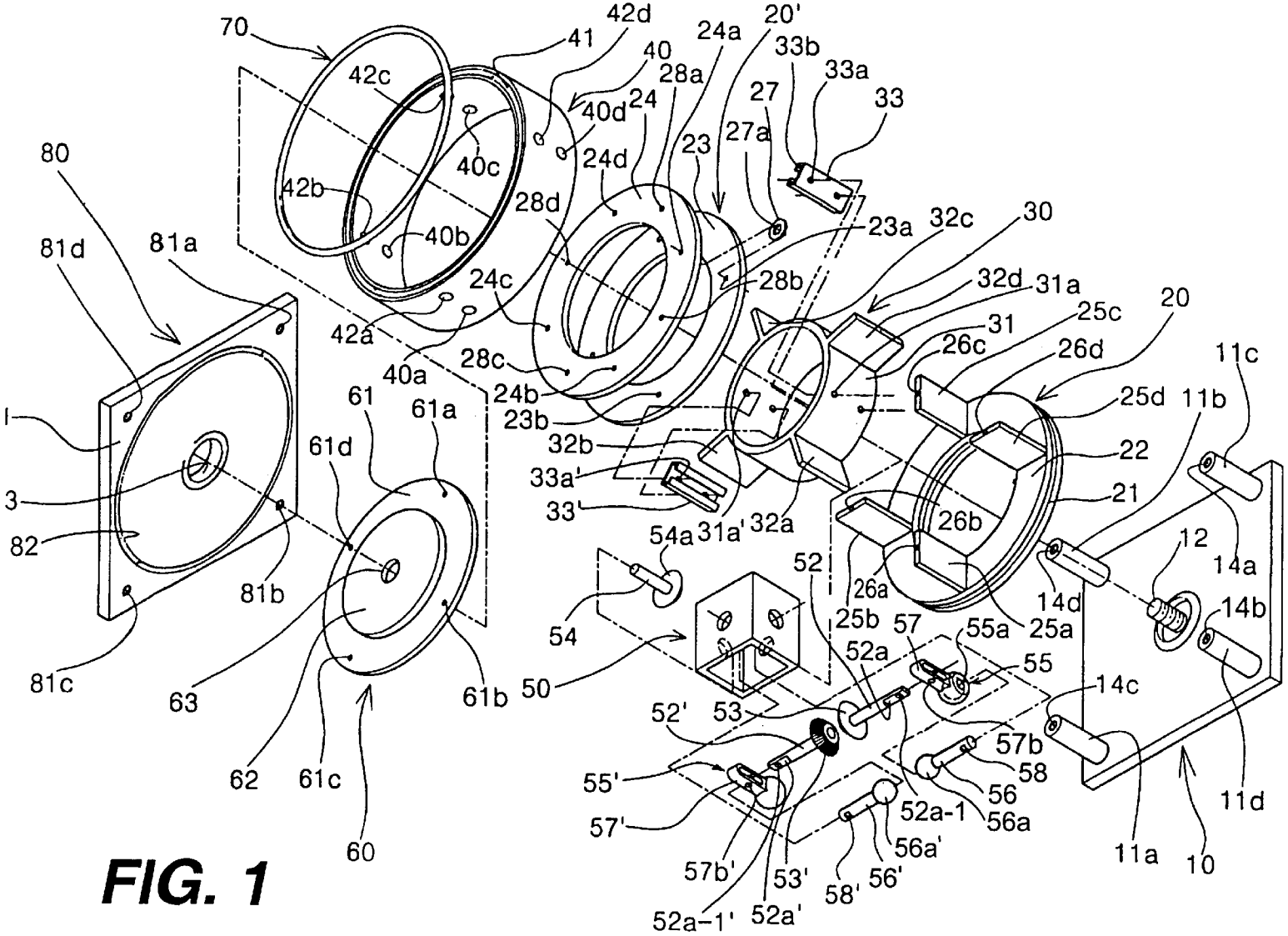
FIG. 1 is an exploded perspective view showing the construction of a coaxial reciprocating axisymmetric (CoReA) engine in accordance with the one embodiment of the present invention.
Figure 2:
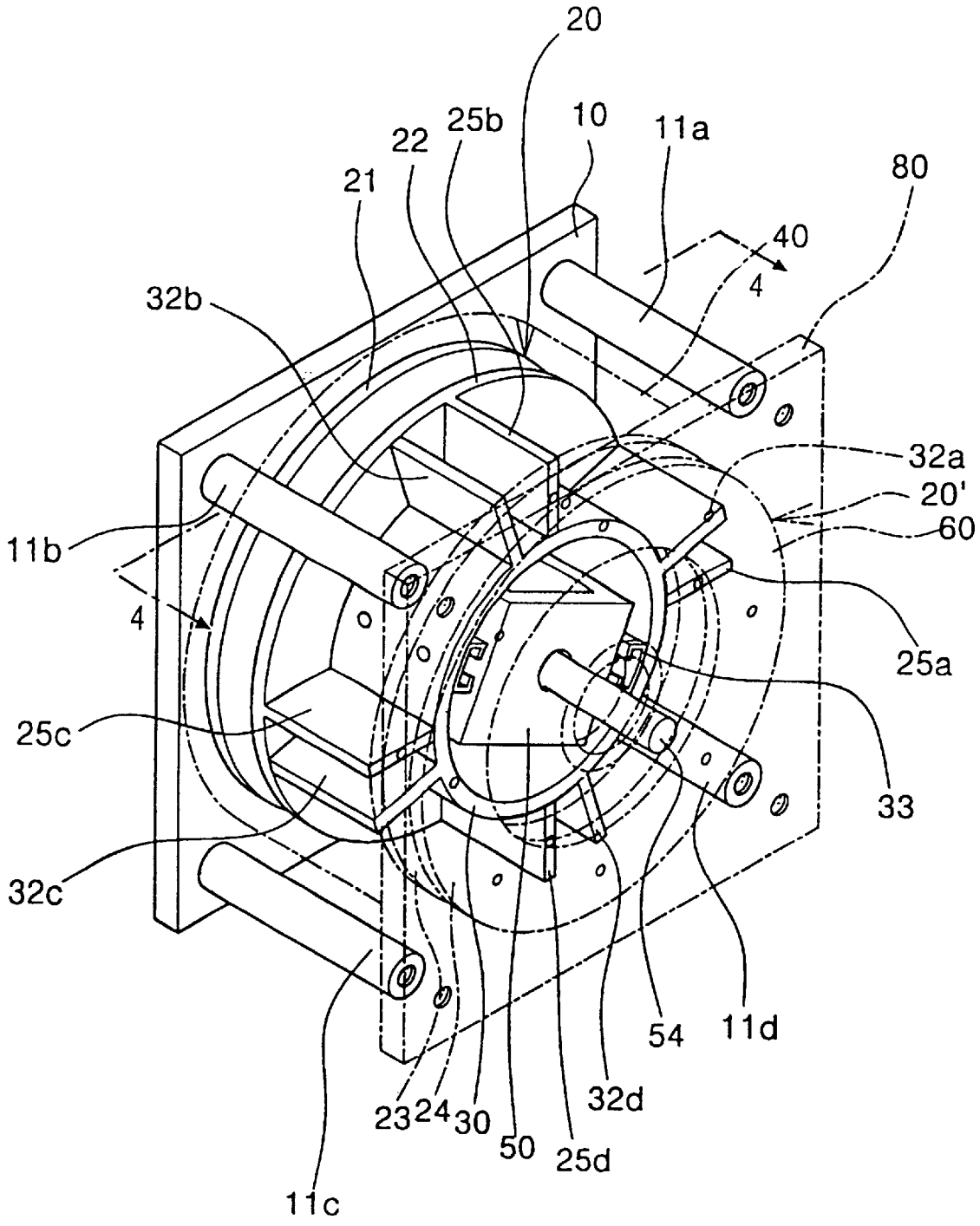
FIG. 2 is a perspective view of the CoReA engine of FIG. 1, with the parts of the engine being assembled into a single body.

FIGS. 1 and 2 are views showing the construction of a coaxial oscillating axisymmetric engine in accordance with the one embodiment of the present invention. As shown in the drawings, a plurality of parts are integrated into a housing assembly. A rotor 30 is set inside the housing assembly, and so forms a plurality of combustion chambers in the housing assembly. A power transmission unit is set in the rotor 30, and transmits the power from the combustion chambers to an output shaft 54.

Briefly described, the CoReA engine of this invention comprises the housing assembly, the rotor 30, two sliders 56 and 56', and the power transmission unit. The housing assembly comprises a rectangular plate 10 having a plurality of internally-threaded bosses 11*a* to 11*d* at its comers. The housing assembly also has two stators: a first stator 20 provided with the plurality of blades 25*a* to 25*d* and a second stator 20'. The position of the above blades 25*a* to 25*d* inside of the housing assembly is fixed, so the blades 25*a* to 25*d* are preferably called fixed blades. The two stators 20 and 20' are placed in a cylindrical housing 40, while a circular sealing member 60 is airtightly coupled to the housing 40. A rectangular cover 80, provided with holes 81*a* to 81*d* at its corners, is screwed to the bosses 11*a* to 11*d* of the plate 10 by conventional bolts or screws, thereby completely forming the housing assembly. The rotor 30 is provided with the plurality of blades 32*a* to 32*d* and is rotatively set inside the housing assembly.

The position of the above blades 32*a* to 32*d* inside of the housing assembly is movable, so the blades 25*a* to 25*d* are preferably called rotating blades. The plurality of combustion, expansion and compression chambers are formed between the fixed blades 25*a* to 25*d* and the rotating blades 32*a* to 32*d* inside of the housing assembly. Two guide rails 33 and 33', individually having a guide channel 33*b*, 33*b*', are mounted to the interior surface of the rotor 30 at diametrically opposite positions.

The two sliders 56 and 56' are movably received in the guide channels 33*b* and 33*b*' of the guide rails 33 and 33', respectively, thus being linearly movable in the guide channels 33*b* and 33*b*'. The power transmission unit comprises two drive shafts 52 and 52', which are respectively coupled to the two sliders 56 and 56'. The two drive shafts 52 and 52' have bevel gears 53, 53' commonly engaging with the output gear 54*a* of the output shaft 54, in result transmitting the power from the sliders 56 and 56' to the output shaft 54 while converting the linear oscillating motion of the sliders 56 and 56' into a rotary motion of the output shaft 54.

A bolt 12 is fixed to the center of the plate 10 and holds a gear box 50 to which the above drive shafts 52 and 52' are rotatively mounted. The bosses 11*a* to 11*d*, provided at the corners of the plate 10, respectively have internal threads 14*a*, 14*b*, 14*c* and 14*d*, so the cover 80 is screwed to the bosses 11*a* to 11*d* at the holes 81*a* to 81*d*. The cover 80, mounted to the housing assembly at a position opposite to the plate 10, has a circular seat 82 on which the sealing means 60 is seated. A center opening 83 is formed at the center of the seat 82, thus receiving the output shaft 54.

The first stator 20 comprises two discs 21 and 22. Of the two discs 21 and 22, the first disc 21 is brought into close contact with the plate 10, while the second disc 22 is arranged in parallel to the first disc 21 with a plurality of spacers 27 (FIG. 1) being interposed between the two discs 21 and 22. The blades 25*a* to 25*d*, formed on the second disc 22, individually have a locking hole 26*a*, 26*b*, 26*c*, 26*d* at the outside end, thus allowing the second disc 22 of the first stator 20 to be locked to third and fourth discs 23 and 24 of the second stator 20'.

The rotor 30 comprises a cylindrical body 31 which is outwardly provided with the same number of blades 32*a* to 32*d* as that of the blades 25*a* to 25*d* of the first stator 20. The above cylindrical body 31 of the rotor 30 also has a plurality of mounting holes 31*a* and 31*a*' at diametrically opposite positions, which permits the two guide rails 33 and 33' to be inwardly and firmly mounted to the cylindrical body 31 at the diametrically opposite positions. Of course, the above guide rails 33 and 33' are individually provided with a plurality of holes 33*a*, 33*a*' at positions corresponding to the mounting holes 31*a*, 31*a*' of the body 31.

As described above, the second stator 20', which is arranged at a position opposite to the first stator 20, comprises the two annular discs: the third and fourth discs 23 and 24. The two annular discs 23 and 24 are arranged in parallel to each other with the plurality of spacers 27 being interposed between the two discs 23 and 24. In order to assemble the two discs 23 and 24 into a single body with the spacers 27, a conventional bolt passes through each smooth hole 24*a*, 24*b*, 24*c*, 24*d* of the fourth disc 24 and the axial hole 27*a* of each spacer 27 prior to being screwed into each internally-threaded hole 23*a*, 23*b*, 23*c*, 23*d* of the third disc 23. A plurality of locking holes 28*a* to 28*d* are formed on the fourth disc 24 in a way such that the locking holes 28*a* to 28*d* and the smooth holes 24*a* to 24*d* are alternately arranged on the disc 24. The above locking holes 28*a* to 28*d* of the fourth disc 24 correspond to the holes 61*a* to 61*d* of the sealing member 60*a*, thus allowing the sealing member 60 to be mounted to the fourth disc 24 by a plurality of conventional screws which pass through the holes 61*a* to 61*d* prior to being screwed to the locking holes 28*a* to 28*d*.

A center opening 63 is formed at the center of the sealing member 60, thus receiving the output shaft 54 which is also fitted into the opening 83 of the cover 80. The above sealing member 60 is partially thickened at a position around the center opening 63, thus providing a flat circular boss 62. The above boss 62 is tightly seated in the openings of the two annular discs 23 and 24 of the second stator 20', as a result the airtightness of the sealing member 60 is improved.

The cylindrical housing 40, surrounding the first and second stators 20 and 20', is provided with a plurality of intake and exhaust ports 40*a* to 40*d* and 42*a* to 42*d*. Each of the intake ports 40*a* to 40*d* is connected to an intake pipe, while each of the exhaust ports 42*a* to 42*d* is connected to an exhaust pipe. One edge of the above cylindrical housing 40 is provided with an annular groove 41 for receiving an O-ring 70.

As described above, the two sliders 56 and 56' are movably received in the guide channels 33*b* and 33*b*' of the guide rails 33 and 33' inwardly mounted to the rotor 30, respectively. Due to the above sliders 56 and 56', the power transmission unit coaxial and axisymmetrically transmits the rotational force from the rotor 30 to the output shaft 54. Each of the sliders 56 and 56' has a guide ball 56*a*, 56*a*' at one end and opposite guide slots 58, 58' at the other end. Each slider 56, 56' thus movably engages with the guide channel 33*b*, 33*b*' of an associated guide rail 33, 33' at the slots 58, 58', so the slider 56, 56' is linearly movable along the guide channel 33*b*, 33*b*'.

A ball housing 55, 55' is coaxial and axisymmetrically coupled to each of the sliders 56 and 56'. The above ball housing 55, 55' comprises a ball seat 55*a*, 55*a*' into which a ball 56*a*, 56*a*' of each slider 56, 56' is inserted. One end of each drive shaft 52, 52' has a flat part 52*a*, 52*a*' at which the shaft 52, 52' is hinged to a connection part 57, 57' extending from the ball seat 55, 55'. In order to allow the flat part 52*a*, 52*a*' of each drive shaft 52, 52' to be hinged to the connection part 57, 57' of each ball housing 55, 55', the flat part 52*a*, 52*a*' and the connection part 57, 57' individually have a locking hole 52*a*-1, 57*b*.

The two drive shafts 52, 52' have the same construction with the holed flat part 52*a*, 52*a*' and the bevel gear 53, 53' at both ends. The above drive shafts 52 and 52' are rotatively set in the gear box 50 with the two bevel gears 53 and 53' being opposite and spaced apart from each other. The two bevel gears 53 and 53' commonly engage with the output gear 54*a* of the output shaft 54, so the drive shafts 53 and 53' transmit the rotational force from the rotor 30 to the output shaft 54. In such a case, the power transmitting passage from the drive shafts 53 and 53' to the output shaft 54 turns at right angles.

FIG. 2 shows the above CoReA engine with the parts being assembled into a single body. In the drawing, both the second stator 20' and the cover 80 are shown by the phantom lines for ease of description and comprehension. In the above engine, the first stator 20 is fixed to the plate 10. Thereafter, the rotor 30 is set on the first stator 20 prior to fixing the second stator 20' to the first stator 20. Accordingly, the first and second stators 20, 20' from a stator assembly with the rotor 30 positioned between the two stators 20 and 20'. The housing 40 is fitted over the stator assembly, thus forming a plurality of variable chambers defined between the blades 32*a* to 32*d* of the rotor 30, the blades 25*a* to 25*d* of the stator assembly and the housing 40. Of course, the combustion chambers have to be sealed. The gear box 50 is set in the rotor 30. The output shaft 54 extends from the gear box 50, thus outputting the rotational force from the rotor 30 during an operational cycle of the engine.

Figure 3A:
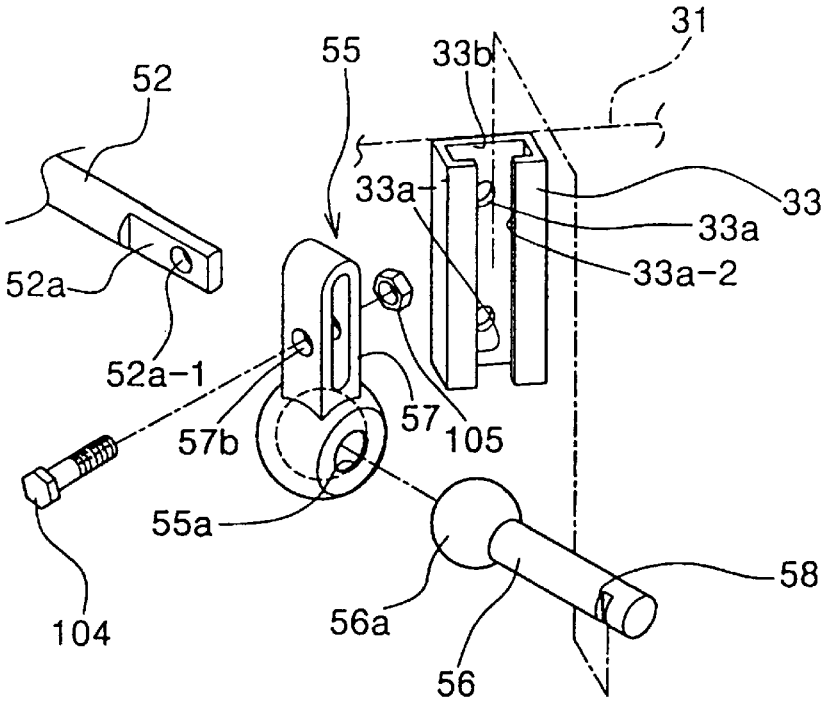
FIGS. 3*a* to 3*c* are exploded perspective views of a power transmission unit used for coaxial and axisymmetrically transmitting the rotational force from a rotor to an output shaft of the engine of FIG. 2.
Figure 3B:
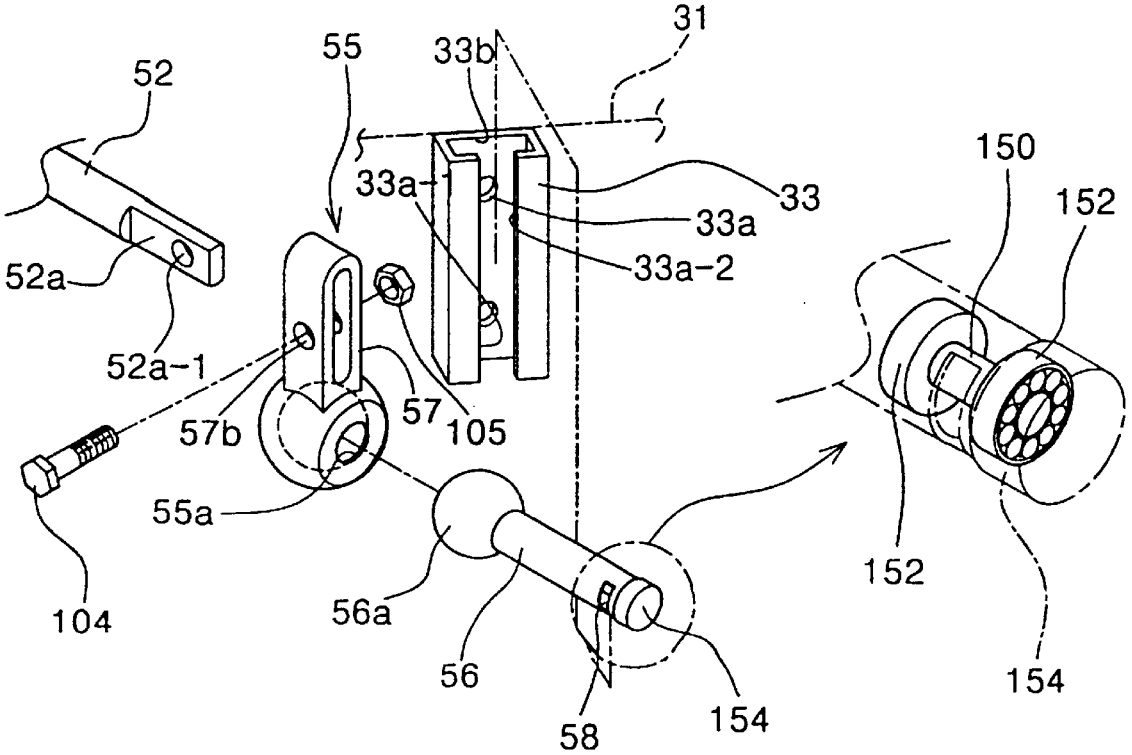
Figure 3C:
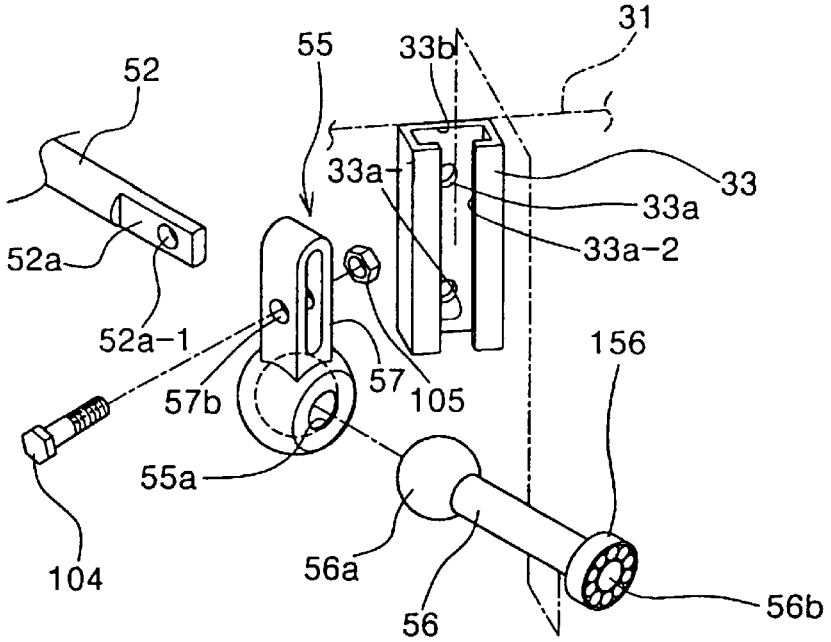

FIGS. 3*a* to 3*c* are exploded perspective views of the power transmission unit used for coaxial and axisymmetrically transmitting the rotational force from the rotor 30 to the output shaft 54. The above power transmission unit comprises two sets of assemblies respectively coupled to the two drive shafts 52 and 52'. However, it should be understood that one of the two assemblies is shown in FIGS. 3*a* to 3*c* for ease of description. As shown in the drawing, the guide rail 33 is provided with two holes 33*a* inside the guide channel 33*b*, so the guide rail 33 is screwed to the interior surface of the rotor 30. Meanwhile, the slider 56 has opposite guide slots 58 at one end. Accordingly, the slider 56 movably engages with the guide channel 33*b* of the guide rail 33 at the guide slots 58, so the slider 56 is linearly movable along the guide channel 33*b* to transmit the rotational force from the rotor 30 to the drive shaft 52.

The slider 56 is coupled to the guide rail 33 at right angles. The guide channel 33*b* of the guide rail 33 is provided with opposite guide edges 33*a*-1 and 33*a*-2 which movably engage with the opposite slots 58 of the slider 56. As a result, the above guide edges 33*a*-1 and 33*a*-2 allow the slider 56 to be linearly movable along the guide channel 33*b* and prevent the slider 56 from being unexpectedly removed from the guide rail 33.

Figure 4A:
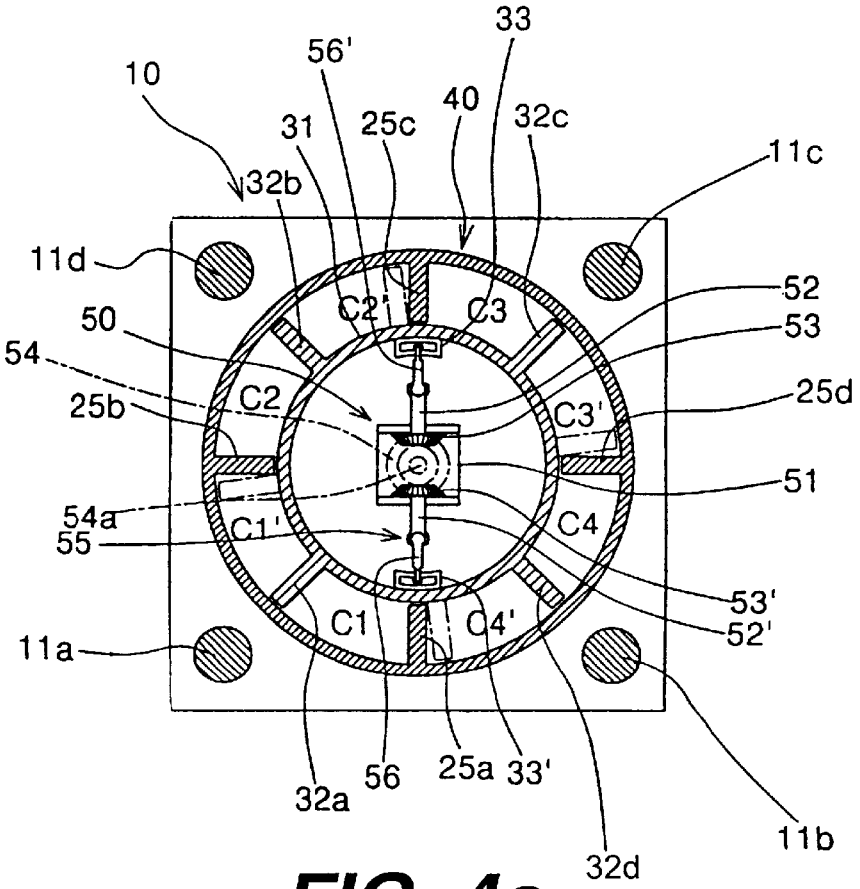
FIGS. 4*a* to 4*c* are sectional views of the engine of this invention taken along the line 4—4 of FIG. 2, showing the operation of the engine.
Figure 4B:
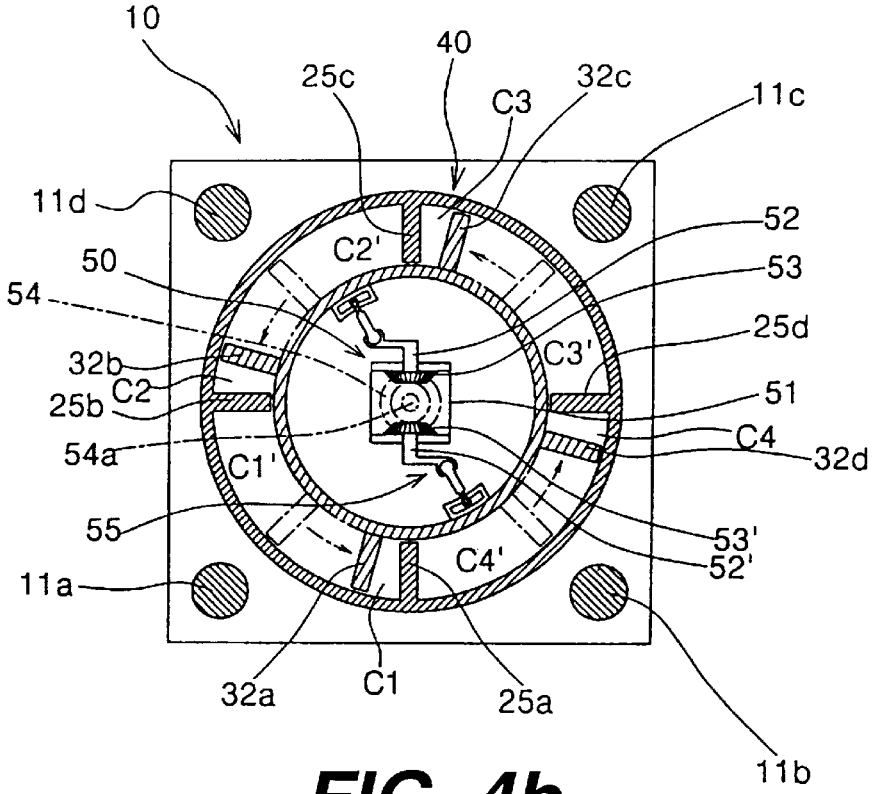
Figure 4C:
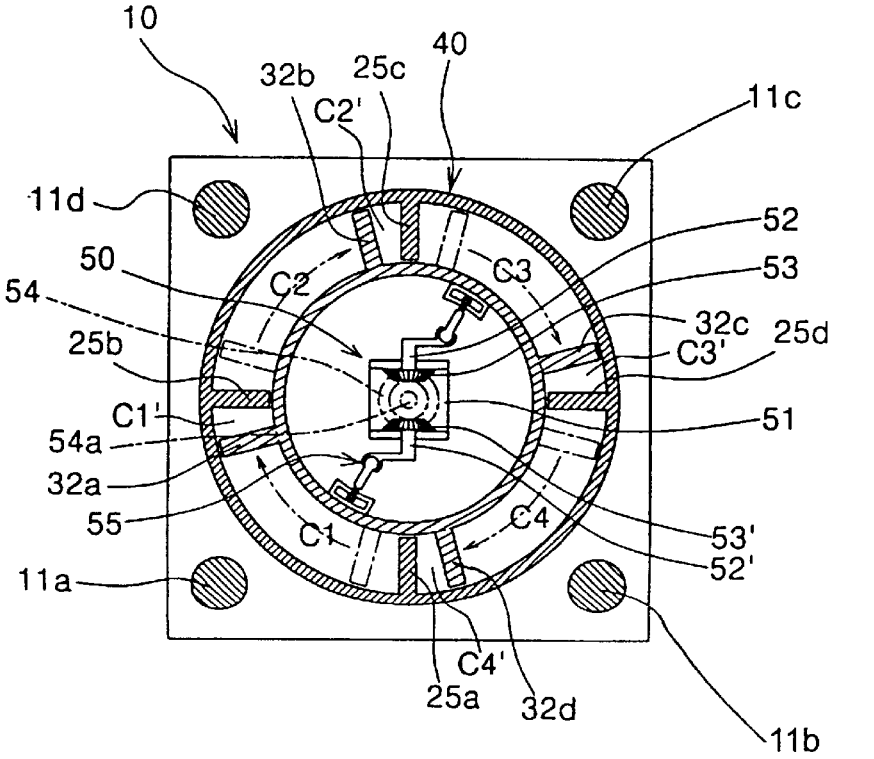
Figure 5A:
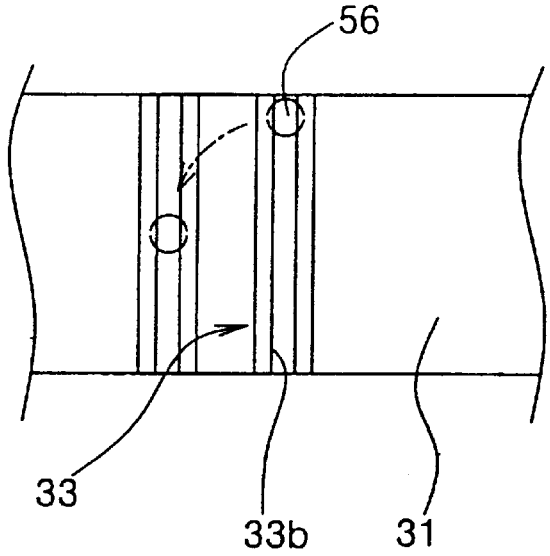
FIGS. 5*a* to 5*d* are views showing a movement of a slider under the guide of a guide channel during each explosion cycle of the engine.
Figure 5B:
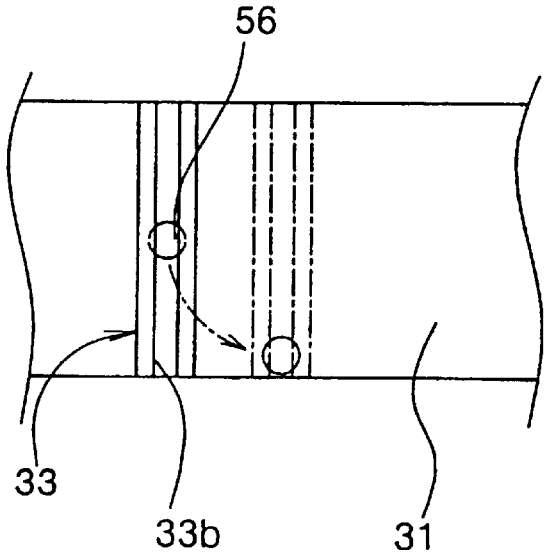
Figure 5C:
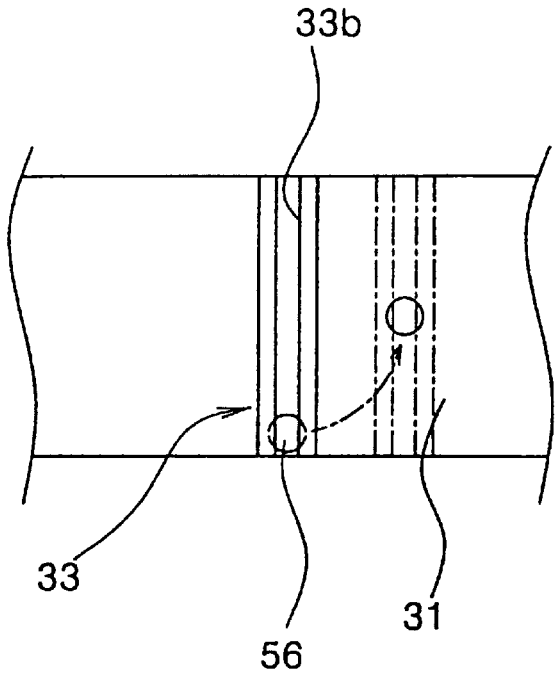
Figure 5D:
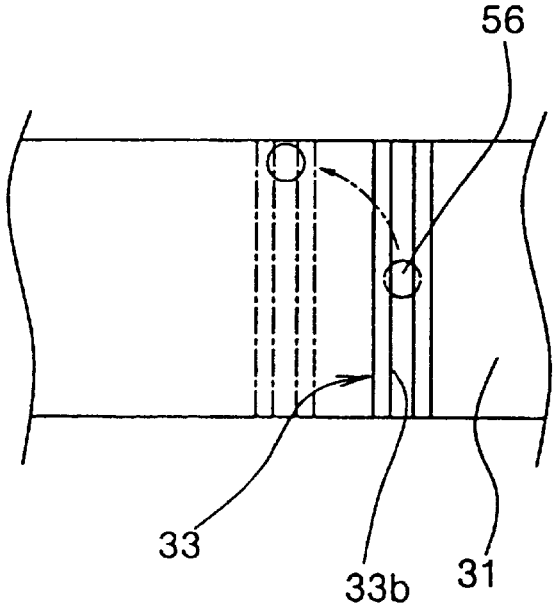

FIGS. 4*a* to 4*c* are sectional views of the engine of this invention taken along the line 4—4 of FIG. 2, showing the operation of it. FIGS. 5*a* to 5*d* are views showing a movement of a slider under the guide of a guide channel during each explosion cycle of the engine.

Referring first to FIGS. 4*a* to 4*c*, the four fixed blades 25*a* to 25*d* of the first stator 20 form four cylinders in the housing assembly. The above four cylinders are also individually divided into two variable chambers by each rotating blades 32*a*, 32*b*, 32*c*, 32*d* of the rotor 30, so the housing assembly has eight combustion chambers. For ease of description, the operation of the CoReA engine of this invention will be described hereinafter with the first rotating blade 32*a* of the rotor 30 being movable between the first and second fixed blades 25*a* and 25*b* of the stator 20. Of course, it should be understood that the remaining rotating blades or the second to fourth blades 32*b* to 32*d* of the rotor 30 are operated in the same manner as that of the first rotating blade 32*a* with regular intervals being formed between the explosion strokes of the blades 32*a* to 32*d*.

As shown in FIG. 4*a*, the first rotating blade 32*a* is positioned between the first and second fixed blades 25*a* and 25*b* when the engine is stopped. In such a case, the slider 56 is positioned at the upper portion of the guide channel 33*b* of the guide rail 33 as shown by the solid line in FIG. 5*a*.

When the above engine is started, external force is transmitted from a power source, such as a start motor, to the sliders 56 and 56' through the drive shafts 52 and 52', while air and fuel are introduced into the first chamber C1 of the first cylinder through the first intake port 40*a* and fuel supplying line which is not shown. In such a case, the slider 56 inside the guide channel 33*b* moves from the position shown by the solid line in FIG. 5*a* to a position shown by the solid line in FIG. 5*b*. That is, the slider 56 moves to the lower portion of the guide channel 33*b*. The first rotating blade 32*a* moves in a direction from the second fixed blade 25*b* to the first fixed blade 25*a* as shown in FIG. 4*b*, thus compressing the mixed fluid of the air and fuel in the chamber C1. At the time the first rotating blade 32*a* reaches the upper dead point or the nearby point in the vicinity of the first fixed blade 25*a*, the mixed fluid is compressed at the highest pressure. In such a case, the slider 56 the inside of the guide channel 33*b* is positioned as shown by the solid line in FIG. 5*c*. When the ignition plug (not shown) is ignited, the compressed mixed fluid is fired in the chamber C1, thus the blade 32*a* returns quickly to the original position as shown in FIG. 4*c*. In such a case, the slider 56 inside the guide channel 33*b* moves from the position shown by the solid line in FIG. 5*c* to the position shown by the phantom line in FIG. 5*d*. Such compression and explosion strokes are performed in the third chamber C3, which is positioned diametrically opposite to the first chamber C1, at the same time.

When the first rotating blade 32*a* moves in a direction from the first fixed blade 25*a* to the second fixed blade 25*b* as described above, the combustion gases are discharged from the first chamber C1 to the atmosphere through the first exhaust port 42*a*, while the mixed fluid in the mating chamber C1' are compressed. That is, each cylinder of the housing assembly comprises a pair of variable chambers, for example, the two chambers C1 and C1'. When each chamber, for example, the chamber C1, performs an expansion stroke, the mating chamber, for example, the chamber C1', performs a compression stroke. Therefore, the engine of this invention, with four cylinders, has eight combustion chambers, so the useful combustion volume of the engine is doubled. This doubles working efficiency per unit volume of the engine.

Figure 6:
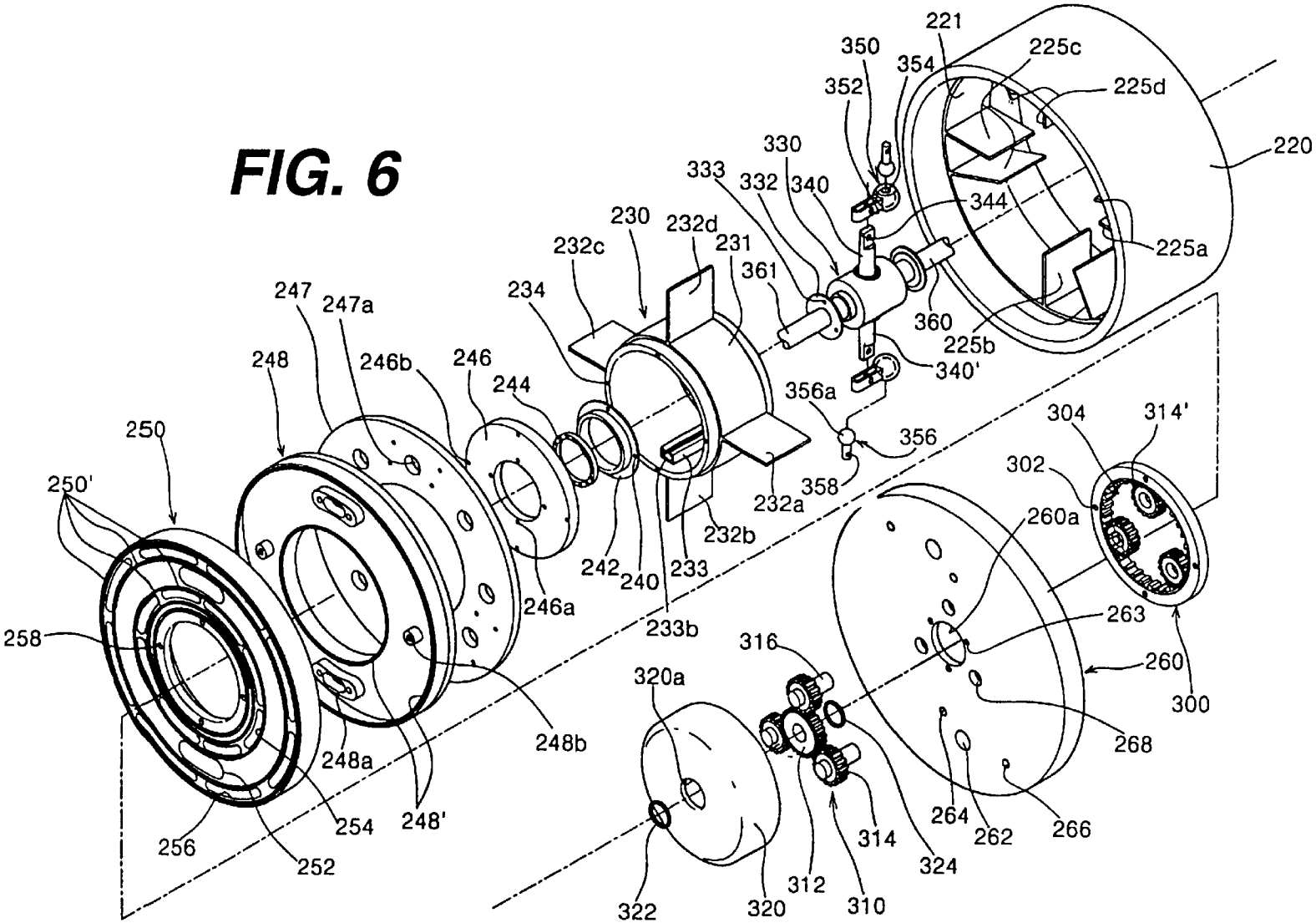
FIG. 6 is an exploded perspective view showing the construction of a CoReA engine in accordance with another embodiment of the present invention.

Referring to FIG. 6, another embodiment of the CoReA engine of this invention is shown. In this embodiment, the CoReA engine comprises a housing 220 provided with a plurality coupled blades 225*a* to 225*d*, a rotor 230 having a plurality of rotating blades 232*a* to 232*d* and two guide rail 233, a power transmission unit 330, a pair of inner covers 246 surrounding the rotor 230, a plurality of coupled first and third fixed discs 247, 248 and 260, a pair of rotating disc valves 250 rotatively arranged between the second fixed disc 248 and the third disc 260, and a pair of valve driving mechanism for driving the rotating disc valve 250. Although only left-hand side components are shown in FIG. 6 other components opposite to the left-hand side components are similarly arranged in parallel to the longitudinal line at the right-hand side but are omitted for the purpose of brevity in the drawing.

Figure 11:
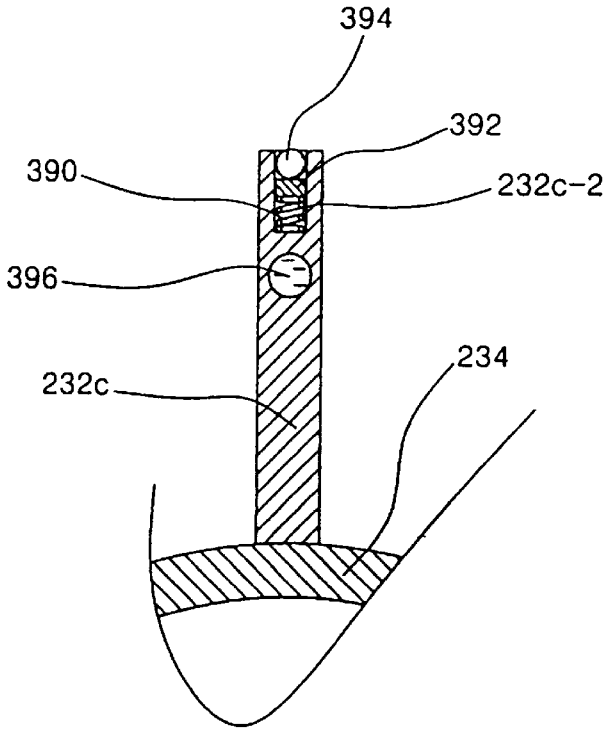

In this embodiment, the cylindrical housing 220 is provided with a plurality of regularly spaced and coupled blades 225*a* to 225*d* which are fixed inwardly of the cylindrical housing 220. Accordingly, the blades 225*a* to 225*d* will be mentioned as "fixed blades" in this embodiment with a same conception of those of the above mentioned embodiment of FIG. 1. Between each pair of fixed blades 225*a*, there may be installed the ignition parts, for example, conventional spark plugs as shown in FIG. 11 might be installed. The cylindrical housing 220 has partially thickened portion 221 circumferentially extending at the interior surface there of and providing a mounting seat for the inner cover 246.

The cylindrical rotor 230 having the plurality of regularly spaced rotating blades 232*a* to 232*d* at its periphery and rotatively arranged inside the cylindrical housing 220, and so the rotating blades 232*a* to 232*d* individually form one variable expansion chamber and one variable compression chamber between the fixed blades 225*a* to 225*d*. Two guide rails 233, individually having a guide channel 233*b*, are mounted to the interior surface of the rotor 230 at diametrically opposite positions. The cylindrical rotor 230 has partially thickened portion 231 circumferentially extending at the exterior surface thereof and also providing a mounting seats for the inner covers 246 in cooperation with the thickened portion 221 of the cylindrical housing 220.

As mentioned above in FIG. 1, the two sliders 356 are movably received in the guide channels 233*b* of the guide rails 233 respectively, thus being linearly movable in the guide channels 233*b*. A ball housing 352 is coaxial and axisymmetrically coupled to each of the slider 356 and comprises a ball seat 354 into which ball 356*a* of each slider 356 is inserted.

The power transmission unit also comprises two driving shafts 340, which are respectively coupled to the two sliders 356. The two driving shafts 340 commonly engaging with the output shaft 360 through the gear box 330, thus transmitting the power from the sliders 356 to the output shaft 360 while converting the linear oscillating motion of the sliders 356 into a rotary motion of the output shaft 360. An idle shaft 361 is arranged in the gear box 330 opposite to the output shaft 360 for driving a valve driving mechanism. The inner cover 246, surrounding both sides of the rotor 230 to form a plurality of combustion chambers of the cylindrical housing 220, has a plurality of screwed holes 246*a* which is connected to the plurality of screwed holes 240 for fixing a retainer 242. As a result, the retainer 242 rotatively supports the inner cover onto the end portion of the gear box 330 using a bearing 244.

The first fixed disc 247 and the second fixed disc 248 are arranged side by side outside of the inner cover 246. Of the discs 247, 248, the first fixed disc 247 has a plurality of inlet holes 247*a* in order to supply air and fuel into the combustion chambers of the cylindrical housing 220 and, the second fixed disc 248 has a plurality of inlet ports 248*a* communicating with the inlet holes 247*a* of the first fixed disc 247. The second fixed disc 248 also has a plurality of screwed holes 248*b* for assembling to the first fixed disc 247.

The rotating disc valve 250, rotatively arranged between the second fixed disc 248 and the third fixed disc 260 has at least two valve holes 252 which periodically communicates with the inlet holes 247*a* of the first disc 247 for supplying air and fuel into the combustion chambers of the cylindrical housing 220. The rotating disc valve 250 is provided with a plurality of coolant inlet holes 254 and coolant outlet holes 256 for cooling the rotating disc valve 250.

Also, the third fixed disc 260 has a plurality of coolant inlet ports 264 communicating with the coolant inlet holes 254 of the valve 250 and the plurality of coolant outlet ports 266 communicating with the coolant outlet holes 256 of the valve 250. A penetrate hole 260*a* is formed at the center of the third fixed disc 260 for rotatively supporting the output shaft 360 or the idle shaft 361 with a bearing 324. Around the center hole 260*a* of the third fixed disc 260, there are three screw holes 263 to which the coupling flange 332 of the gear box 330 is assembled by use of screws at a plurality of screw holes 333 of the flange 332.

In order to drive the rotating disc valve 250, a ring gear assembly 300 is applied to the CoReA engine of this embodiment. The ring rear assembly 300 is provided with an internal ring gear 304 assembled to the rotating disc valve 250 by conventional screws at the plurality of screwed holes 302. The internal ring gear 304 always mesh with a plurality of (commonly, three) pinions 314' of a pinion gear assembly 310.

A valve driving mechanism, for periodically opening one of the inlet holes 247*a* of the first fixed disc 247 in order to supply air and fuel into the combustion chambers of the cylindrical housing 220, consists of: a sun gear 312 mounted on the output shaft 360 or the idle shaft 361; a pinion gear assembly 310 having a pinion shaft 316 being rotatively supported by the third fixed disc 260 at a penetrate hole 268, a plurality of first pinions 314 fixed to an end of the pinion shaft 316 for meshing with the sun gear 312, and the plurality of second pinions 314' fixed to the other end of the pinion shaft 316; and the ring gear assembly 300 provided with a internal ring gear 304 for meshing with the second pinions 314' and connected to the rotating disc valve 250.

The outer cover 320 is coupled to the third fixed disc 260, and so surrounds the sun gear 312 and the pinion gear assembly 310. As mentioned above, the penetrate hole 260 of the third fixed disc 260, a penetrate hole 320*a* is also formed at the center of the outer cover 320 for rotatively supporting the output shaft 360 or the idle shaft 361 with a bearing 322.

Figure 7:
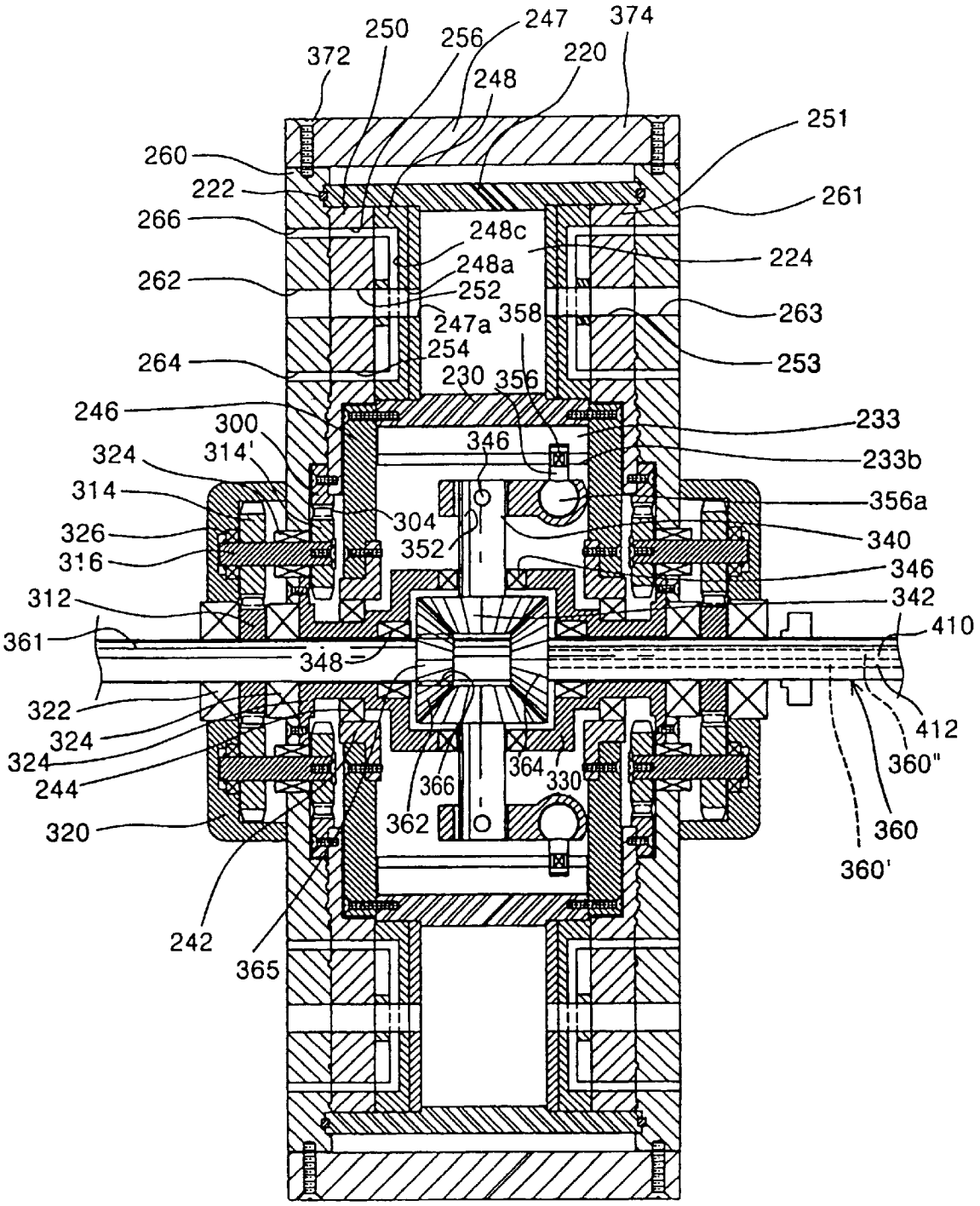
FIG. 7 is a sectional view of a CoReA engine in accordance with another embodiment of the present invention.

FIG. 7 is a sectional view of the CoReA engine in accordance with another embodiment of this invention. As compared to the FIG. 6, a casing 374 is added in order to couple with the third fixed disc 260 by a screw 372, and so airtightly surrounding the outside of the cylindrical housing 220. Both the gear box 330 and the power transmission unit are cased by the rotor 230 and the inner cover 246, and are filled with lubrication oil through an oil passage 360' of the output shaft 360. Also, the output shaft 360 is provided with a coolant passage 360" in order to supply coolant to a coolant passage 396 of FIG. 7.

The gear box 330 is positioned at the center of the CoReA engine, while the output shaft 360 and the idle shaft 361 are extended outwardly therefrom in opposed direction to each other. An output gear 364, always meshing with drive gears 342 of the driving shaft 340, is firmly secured to the output shaft 360, while an idle gear 365 is rotatively mounted on the idle shaft 361 with a bearing 366, thus simultaneously rotating the shafts 360 and 361 by the linear oscillating motion of the sliders 356 through the drive shaft 340.

A variable compression chamber and the variable expansion chamber are periodically provided between the rotor 230 and the cylindrical housing 220. Because fixed discs 247, 248, 260 and rotating disc 250 have almost the same construction at diametrically opposed direction, the reference numerals of the right-hand side parts are omitted, except a rotating disc valve 251 having at least two valve holes 253 which periodically communicate with the exhaust port 263 of the third fixed disc 261 for discharging the exhaust gas from the combustion chamber 224.

As described above, the two planetary gear sets, used for operating the rotating disc valves 250 and 251', individually comprise the sun gear 312; the pinion gear assembly 310 having the pinion shaft 316, the first pinions 314 and the second pinions 314'; and the ring gear assembly provided with a internal ring gear for driving the rotating disc valve 250. When the sun gear 312 of each planetary gear set is rotated along with the shaft 360, 360', the supplied rotating force from the rotor 230 through the slider 340 is transmitted to the ring gear 304 through the pinions 314, 314', and so rotating the rotating disc valves 250, 250', respectively.

In the operation of the engine, the above valve driving mechanism sucks and exhausts gases relative to the combustion chambers 224 of the cylindrical housing 220 as follows. When the rotational force of the rotor 220 is transmitted to the output shaft 360 through the power transmission unit, the output shaft 360 is rotated along with the idle shaft 361, so each of the two shafts 360 and 361 transmits the rotational force from the rotor 220 to the associated rotating disc valves 250 and 251 through the valve driving mechanism comprising the sun gear 132, the pinion gears 314, 314' and the ring gear 304.

The rotating disc valves 250 and 251, are airtightly and rotatively interposed between the second fixed disc 248 and the third fixed disc 260. When the rotating disc valve 250 is rotated, the valve holes 252 communicate with the intake port 262 of the third fixed disc valve 260, the inlet port 248*a* of the second fixed disc 248 and the inlet hole 247*a* of the first fixed disc 247, thus filtered air and fuel are introduced into the combustion chamber 224. In the same manner, a rotating action of rotating disc valve 251 enables discharge of exhaust gas from the combustion chambers 224 to the atmosphere.

In this embodiment, The CoReA engine has a second cooling unit consisting of inlet coolant holes 264, 254 and outlet coolant holes 266, 256 which are formed the third fixed disc 260 and the rotating disc valve 250, in respectively, as well as a ventilate hole 248*c* of the first fixed disc 248, thus circulating coolants by a centrifugal force which is generated by rotation of the rotating disc valve 250.

Figure 8A:
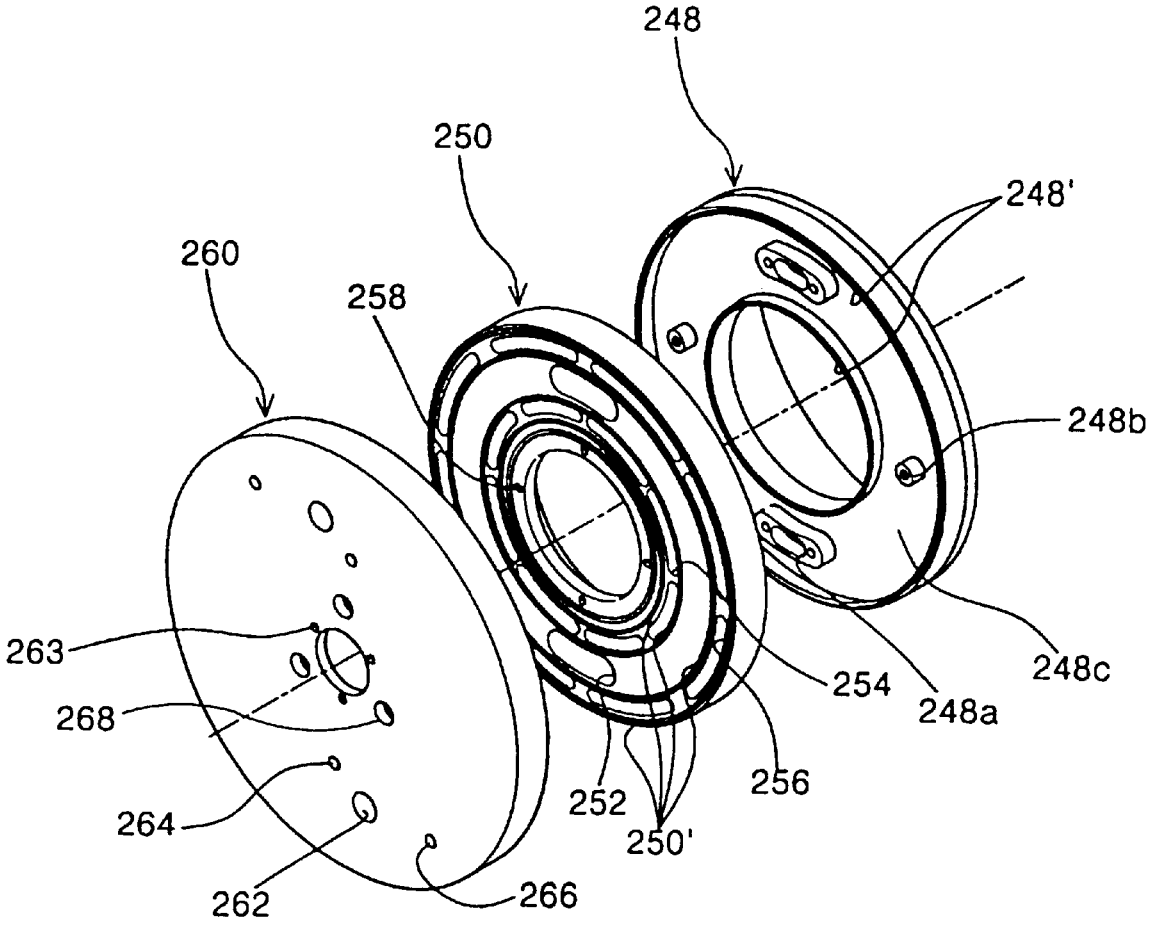
FIGS. 8*a* and 8*b* are front and rear perspective views of a rotating disc valve and fixed discs using the CoReA engine of FIG. 6, respectively.
Figure 8B:
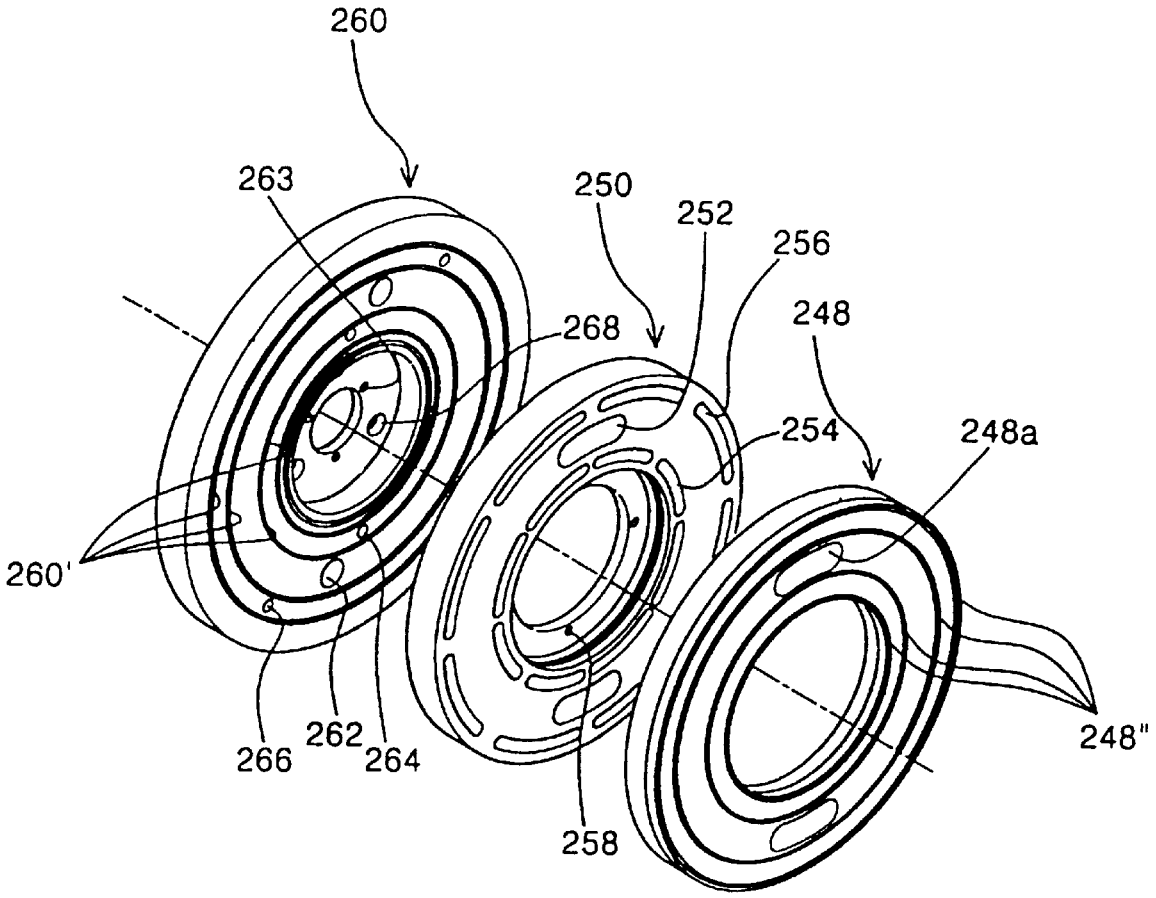

FIGS. 8*a* and 8*b* are front and rear perspective views of the second fixed disc 247, the rotating disc valve 250 and the third fixed disc 260 using the CoReA engine according to this embodiment, in turn. As shown in FIGS. 8*a* and 8*b*, there are a plurality of circular projecting portions for reducing the frictional force resulting from the continuous contact between the second fixed disc 248 and the rotating disc valve 250 or between the rotating disc valve 250 and the third fixed disc 260. The first fixed disc 248 has a first projecting portion 248' and a second projecting portion 248" at its both sides, and the rotating disc valve 250 also has a third projecting portion 250' at one side in opposite to the second fixed disc 248, while the third fixed disc 260 has a fourth projecting portion 260' frictionally contacting with the third projecting portion 250' of the rotating disc valve 250. Although not shown in the FIGS. 8*a* and 8*b*, it is preferable to locate oil-less bearings between the projecting portions, for example, between the third projection portion 250' of the rotating disc 250 and the fourth projecting portion 260' of the third fixed disc 260 for sealing and lubricating of the frictional contacting parts.

Figure 9:
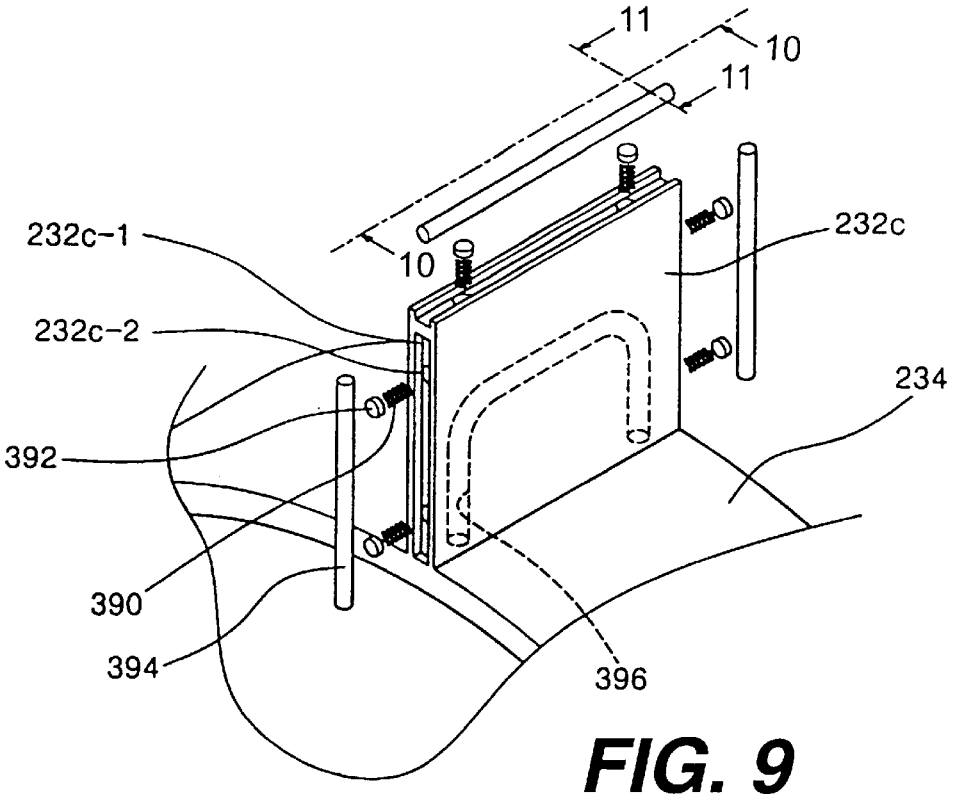
FIG. 9 is an enlarged perspective view showing the structure of a first lubrication unit for lubricating the rotating blade of the rotor.
Figure 10:
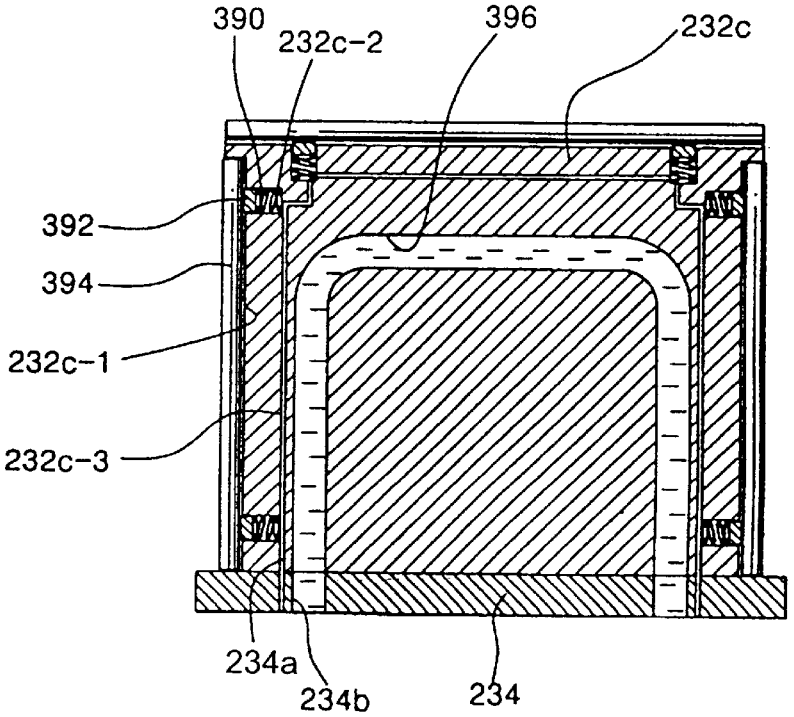
FIGS. 10 and 11 are sectional views along the line 10—10 and 11—11 of FIG. 9, showing the inside construction of the first lubrication unit.

FIG. 9 is an enlarged perspective view showing the structure of a first lubrication unit for lubricating the rotating blade of the rotor. FIGS. 10 and 11 are sectional views along the line 10—10 and 11—11 of FIG. 9. In order to lubricate the rotating blade 232*c* of the rotor 230, three lubrication rolls 394 are set in the oil grooves 223*c*-1 provided along the cylindrical housing 220 and the inner covers 246 contact edge of rotating blade 232*c* and are biased by at least one plunger 392 with at least spring 390 which are both retained in the oil chamber 232*c*-2.

The cylindrical body 234 of the rotor 230 contains lubrication oil and has a plurality of oil holes 234*c* on the outside of surface thereof, thus discharged oil from the oil holes 234*c* supply into the oil chamber 232*c*-2 between the opposite fixed blades 225*c*. In the oil chamber 232*c*-2, outer surface of the cylindrical body 234 is covered with oil. As mentioned above, the plungers 228*d* are deformed by the springs 228*c*, thus allowing the lubrication roll 229 to smoothly roll along the outer surface of the cylindrical body 234.

The rotating blade 232*c* of the rotor 230 is also provided with a first cooling unit consisting of the coolant jacket 396. In this specification, the terms of the "first" is only used for comparing with the second cooling unit mentioned above in FIG. 7, not relation to the sequence of order. The coolant jacket 396 communicates with the coolant passage 360" of the output shaft 360 through a conventional water hose(not shown) and a plurality of coolant inlet holes 234*b*.

Figure 12:
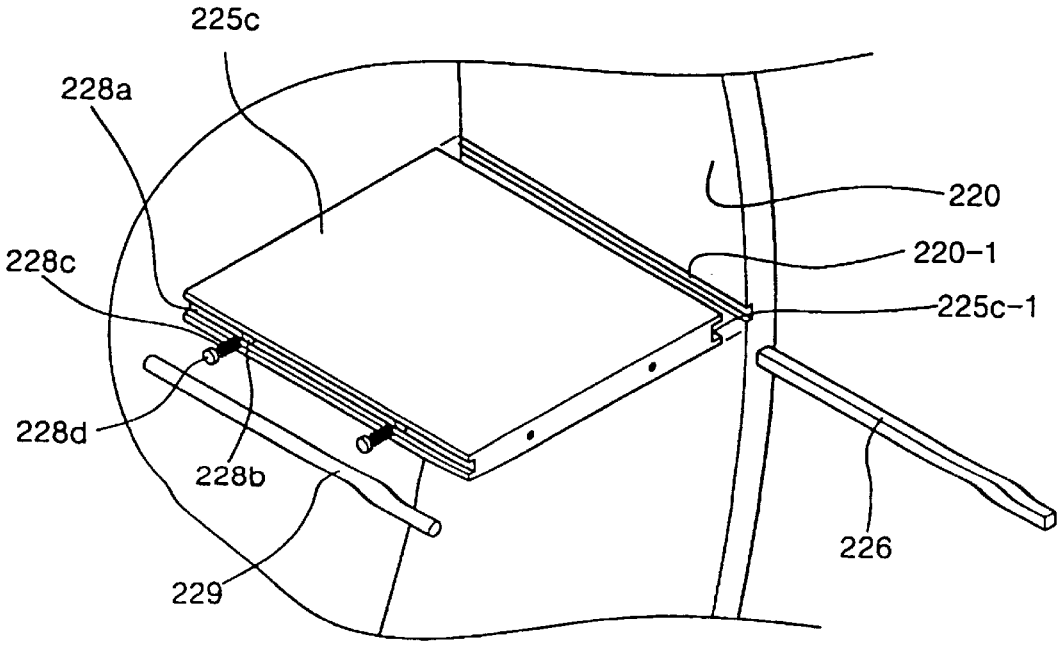
FIG. 12 is an enlarged perspective view showing the structure for assembling a fixed blade to a cylindrical housing of the CoReA engine of FIG. 6.

FIG. 12 is an enlarged perspective view showing the fixed blade 225*c* which is assembled to the cylindrical housing 220. In order to lubricate the fixed blade 225*c*, a lubrication roll 229 is set in the oil groove 228*a* provided along the rotor contact edge of the fixed blade 255*c*, and is biased by at least one plunger 228*d* with at least one spring 228*c* which are retained in the oil chamber 228*b*. In the oil groove 228*a*, the lubrication roll 394 is covered with oil being supplied with an oil jacket (not shown), similar to that of the rotating blade 232*c*. The plungers 228*d* are deformed by the springs 228*b*, thus allowing the lubrication roll 229 to smoothly roll the inside of the groove 228*a* as mentioned above.

The fixed blade 225*c* also provided with a groove 225*c*-1 at opposite edge to the oil groove 228*a* for receiving a packing 226. In combination, the packing 226 is installed between the groove 225*c*-1 and an opposite groove 220-1 formed the inside of the cylindrical housing 220, accordingly the fixed blade 225*c* firmly and airtightly adhere to the cylindrical housing 220. Even if the separate type blades 225*a* to 225*d* were used in this embodiment, for a simple geometric configuration of the engine, the fixed blades 225*a* to 225*d* may be formed on the interior surface of the cylindrical housing as a single body.

Figure 13:
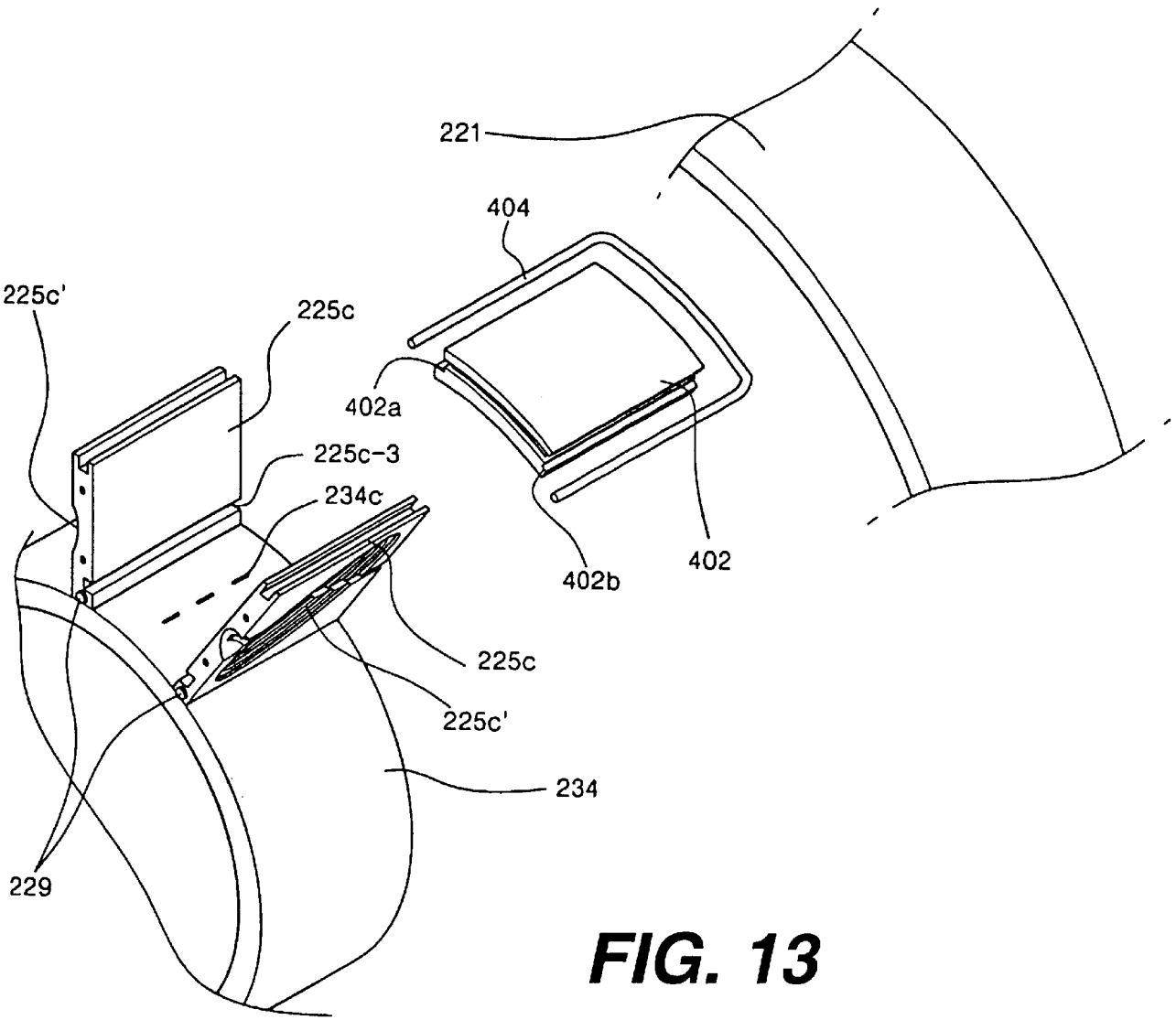
FIG. 13 is an enlarged perspective view showing the structure of a second lubrication unit of the CoReA engine of FIG. 6.
Figure 14:
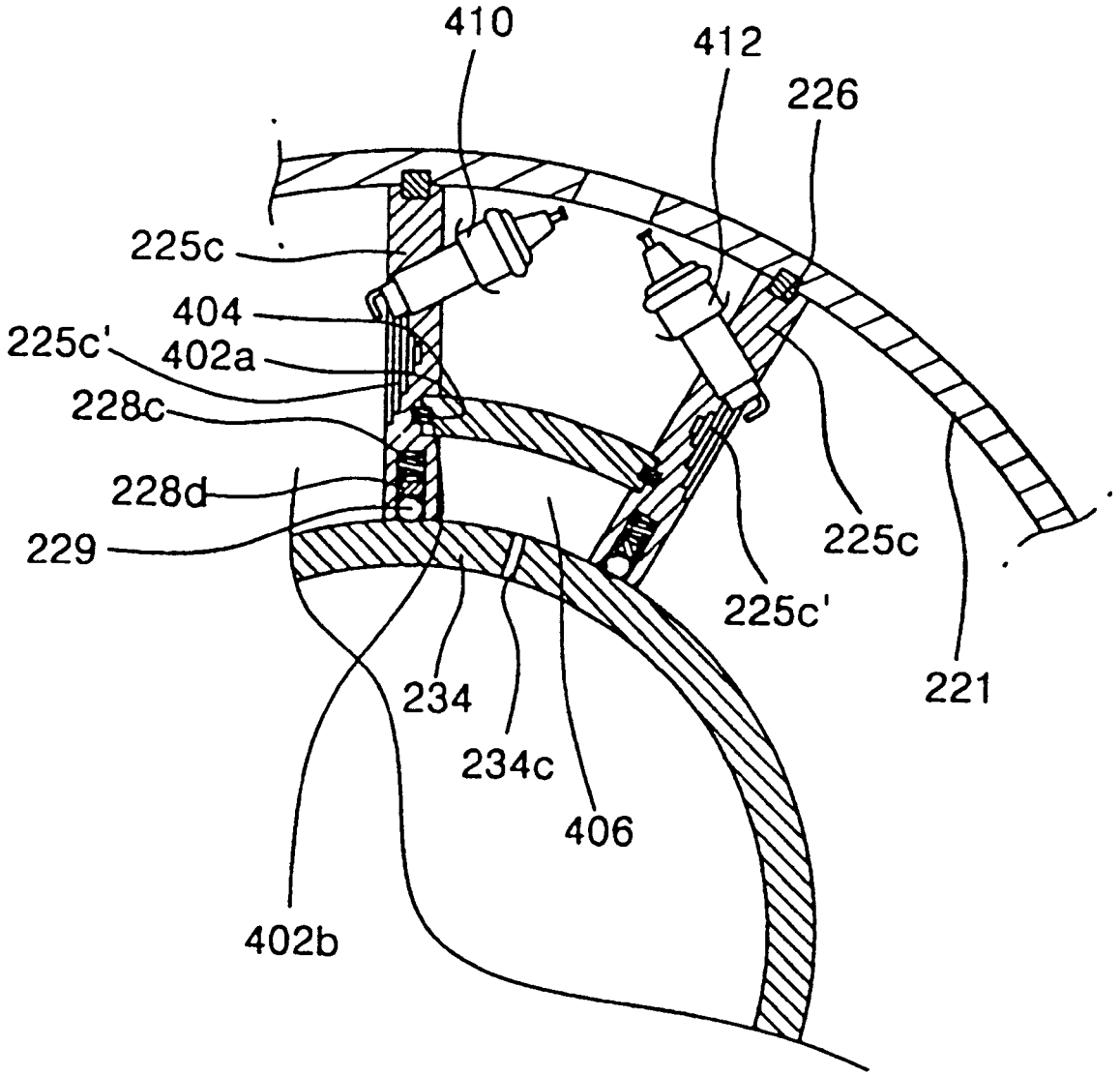
FIG. 14 is an enlarged sectional view showing the assembled structure of the second lubrication unit and spark plugs FIG. 13.

FIGS. 13 and 14 are an enlarged perspective view and a sectional view showing the structure of a second lubrication unit for lubricating the rotating surface of the rotor in accordance with this embodiment. As shown in the drawings, a pair of fixed blades 225*c* provide with a slot 225*c*-3 which is formed at the lower opposite side thereof respectively, and a lid 402 inserts into the slot 225*c*-3 at the both ends flange there of providing an oil chamber between the opposite fixed blades 225 with a packing 404.

The cylindrical body 234 of the rotor 230 containing lubrication oil has a plurality of oil holes 234*c* on the outside surface, thus discharged oil from the oil holes 234*c* supply into the oil chamber 232*c*-2 formed between the opposite fixed blades 225*c*. In the oil chamber 232*c*-2, outer surface of the cylindrical body 234 is covered with oil. As mentioned above, the plungers 228*d* are deformed by the plunger 228*d* with the springs 228*c*, thus allowing the lubrication roll 229 to smoothly roll along the circumferential surface of the cylindrical body 234.

In the space portion between the opposite blades 225*c* fixed to a cylindrical body 221 of the cylindrical housing 220, two spark plugs 410, 412 are positioned with an incline of appropriate degrees for supplying flames into the combustion chambers of the engine.

Industrial Applicability

As described above, this invention provides a CoReA engine. The engine of this invention is provided with a rotor having a plurality of rotating blades, which are movable relative to a plurality of fixed blades of a stator in opposite directions while forming expansion and compression chambers in each cylinder of a housing assembly, thus generating rotational force which is transmitted to an output shaft through a power transmission unit. Since the engine of this invention is free from any crank shaft, thus being effectively lightened. The engine of this invention has four cylinders each of which is divided into two combustion chambers by a rotating blade of the rotor, so the useful combustion volume of the engine is doubled. This doubles working efficiency per unit volume of the engine. In addition, the engine is free from any cam shaft or valve drive mechanism, thus having a simple construction.

The engine is also free from operational vibrations caused by crank shafts, so the engine is operated silently. The engine has a simple geometric configuration, thus being easily produced in large quantities and improving productivity. In the engine, the number of cylindrical housing assemblies can be increased by a desired multiple of two, so it is easy to enlarge the volume of the combustion chambers. The engine also has linear blades different from typical engines, thus effectively increasing output torque. Furthermore, the engine is free from any inertial flywheel, thus being effectively lightened and being silently operable. In comparison with typical coaxial reciprocating engines, the engine of this invention uniformly distributes output power during a normal operation. Another advantage of the engine of this invention resides in that the parts of the engine are easily produced and assembled through a simple process, so the engine is effectively produced on a commercial scale.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A coaxial oscillating axisymmetric engine, comprising a housing assembly comprising;

a first stator consisting of first and second annular discs, said second disc being provided with a plurality of regularly spaced fixed blades at one side thereof, a second stator arranged in parallel to and spaced apart from said first stator, thus forming a stator assembly in cooperation with the first stator, said second stator consisting of third and fourth annular discs, a cylindrical housing fitted over said first and second stators, thus closing the periphery of the stator assembly, a plate arranged outside of the first stator, and a cover arranged outside of the second stator and integrated with said plate using a plurality of locking bosses;

a cylindrical rotor having a plurality of regularly spaced rotating blades at its periphery and rotatively arranged the inside of the housing assembly with the rotating blades being positioned between the fixed blades of the first stator, said rotating blades individually forming one variable expansion chamber and one variable compression chamber between the fixed blades;

a gear box arranged the inside of the rotor;

a toothed output shaft rotatively set in said gear box and extending to the outside of said housing assembly; and a power transmission unit used for coaxial and axisymmetrically transmitting a rotating force of the rotor to said output shaft through two toothed drive shafts, said drive shafts commonly engaging with the output shaft at their toothed parts the inside of the gear box.

2. The coaxial oscillating axisymmetric engine according to claim 1, wherein said power transmission unit comprises:

two guide rails inwardly mounted to said rotor at diametrically opposed positions and individually having a guide channel;

a slider having a guide ball and a guide slot at both ends and movably engaging with each of said guide rails so as to be linearly movable along the guide channel; and a ball housing coaxial and axisymmetrically coupled to said slider, said ball housing consisting of:

a ball seat rotatively receiving the ball of the slider; and a connection part extending from said ball seat and rotatively coupled to each of said drive shafts.

3. A coaxial oscillating axisymmetric engine, comprising:

a cylindrical housing being provided with a plurality of regularly spaced fixed blades;

a cylindrical rotor having a plurality of regularly spaced rotating blades at its periphery and rotatively arranged inside the cylindrical housing, said rotating blades individually forming one variable expansion chamber and one variable compression chamber between the fixed blades of the cylindrical housing;

a gear box arranged the inside of the rotor;

a toothed output shaft rotatively set in said gear box and extending to the outside of said housing assembly;

an idle shaft is provided with an idle gear meshing with the opposite bevel gears of the two toothed driving shafts and arranging opposite side of the output gear of the output shaft;

a power transmission unit used for coaxial and axisymmetrically transmitting a rotating force of the rotor to the output shaft through the driving shafts;

inner covers surrounding both sides of said rotor to form a plurality of combustion chambers of the cylindrical housing;

rotating disc valves being arranged the outside each of the second fixed disc and having at least two valve holes which periodically communicate with the combustion chambers of the cylindrical housing;

valve supporting means rotatively supporting the rotating disc valves;

valve driving mechanisms to rotate the rotating disc valves.

4. The coaxial oscillating axisymmetric engine according to claim 3, wherein said valve supporting means comprises:

a first fixed disc being arranged the outside of each of the inner covers and having a plurality of inlet holes;

a second fixed disc being arranged the outside of each of the first fixed disc and having two inlet ports communicating with the inlet holes;

a third fixed disc being arranged the outside of each of the rotating disc valves and having two intake ports communicating with the inlet ports.

5. The coaxial oscillating axisymmetric engine according to claim 3, wherein said power transmission unit comprises:

two guide rails inwardly mounted to said rotor at diametrically opposite positions and individually having a guide channel;

a slider having a guide ball and a guide slot at both ends and movably engaging with each of said guide rails so as to be linearly movable along the guide channel; and a ball housing coaxial and axisymmetrically coupled to said slider, said ball housing consisting of:

a ball seat rotatively receiving the ball of the slider; and a connection part extending from said ball seat and rotatively coupled to each of said drive shafts.

6. The coaxial oscillating axisymmetric engine according to claim 3, wherein there is further provided a valve driving mechanism comprising:

two planetary gear sets consisting of:

a sun gear being rotated with the output shaft or the idle shaft;

a pinion gear assembly having a pinion shaft being rotatively supported by the third fixed disc, a plurality of first pinions fixed to an end of the pinion shaft meshing with the sun gear, and a plurality of second pinions fixed to the other end of the pinion shaft; and a ring gear assembly provided with a internal ring gear meshing with the second pinions and connected with the rotating disc valve.

7. The coaxial oscillating axisymmetric engine according to claim 3, wherein the first fixed disc has a first projecting portion and a second projecting portion at its both sides, and the rotating disc valve also has a third projecting portion at one side opposite to the second fixed disc, while the third fixed disc valve has a fourth projecting portion which is frictionally contact with the third projecting portion of the rotating disc valve.

8. The coaxial oscillating axisymmetric engine according to claim 3, wherein the rotating blade of the rotor are provided with a first cooling unit consisting of a coolant jacket that communicated with a coolant passage of the output shaft through a plurality or coolant inlet holes of the rotor.

9. The coaxial oscillating axisymmetric engine according to claim 3, wherein the rotating blades of the rotor are provided with a second cooling unit consisting of inlet coolant holes and outlet coolant holes which are formed in the third fixed disc and the rotating disc valve, in respectively, as well as a ventilate hole of the first fixed disc.

10. The coaxial oscillating axisymmetric engine according to claim 3, wherein the rotating blade of the rotor is provided with a first lubrication unit comprising:

an oil jacket formed inside of the rotating blade flowing oil from an oil passage of the output shaft;

an oil groove formed along the outside edge of the rotating blade communicating with the oil jacket through an oil chamber;

a lubrication roll movably received in the oil groove; and at least one plungers retained in the oil chamber in order to bias the lubrication roll to outer surface of the rotor by plurality of springs.

11. The coaxial oscillating axisymmetric engine according to claim 3, wherein a space portion formed between the fixed blades of the cylindrical housing are provided with a second lubrication unit comprising:

a slot formed in the opposite lower side of the fixed blades;

a lid being inserted between the slot at the both ends flange thereof to provide an oil chamber between the opposite fixed blades.

12. The coaxial oscillating axisymmetric engine according to claim 3, wherein a space portion formed between the fixed blades of the cylindrical housing is positioned spark plugs with an incline of appropriate degrees for supplying flames into the combustion chambers of the cylindrical housing.

* * * * *